US007344120B2

(12) United States Patent
McFarland

(10) Patent No.: US 7,344,120 B2
(45) Date of Patent: Mar. 18, 2008

(54) RECEIVER WINCH MOUNT

(76) Inventor: Shawn M. McFarland, 351 W. Pine St., Carlinville, IL (US) 62626

( * ) Notice: Subject to any disclaimer, the term of this patent is extended or adjusted under 35 U.S.C. 154(b) by 214 days.

(21) Appl. No.: 11/377,553

(22) Filed: Mar. 17, 2006

(65) Prior Publication Data

US 2006/0289844 A1 Dec. 28, 2006

Related U.S. Application Data

(60) Provisional application No. 60/681,144, filed on May 16, 2005.

(51) Int. Cl.
*B66D 1/00* (2006.01)

(52) U.S. Cl. ..... 254/323; 224/511

(58) Field of Classification Search ..... 254/323; 224/511–514

See application file for complete search history.

(56) References Cited

U.S. PATENT DOCUMENTS

| | | | | | |
|---|---|---|---|---|---|
| 3,788,605 | A | | 1/1974 | Johnson | |
| 3,900,214 | A | | 8/1975 | Brockelsby | |
| 4,204,701 | A | | 5/1980 | Oltrogge | |
| 4,620,736 | A | | 11/1986 | Shanks | |
| 4,775,282 | A | * | 10/1988 | Van Vliet | 414/462 |
| 4,799,609 | A | * | 1/1989 | Castilla | 224/513 |
| D306,415 | S | | 3/1990 | Godbersen | |
| 4,950,010 | A | | 8/1990 | Denny | |
| 5,072,962 | A | | 12/1991 | Webb | |
| 5,350,186 | A | | 9/1994 | Hull | |
| 5,375,773 | A | * | 12/1994 | Lewis | 239/650 |
| 5,588,633 | A | | 12/1996 | McCrerie | |
| 5,593,139 | A | | 1/1997 | Julian | |
| 5,913,507 | A | | 6/1999 | Lauricella | |
| 5,971,363 | A | | 10/1999 | Good | |
| D432,469 | S | | 10/2000 | Nelson | |
| 6,138,992 | A | | 10/2000 | Bell | |
| 6,152,425 | A | * | 11/2000 | Boyer | 254/323 |
| 6,386,514 | B1 | | 5/2002 | Ray | |
| 6,460,907 | B2 | | 10/2002 | Usui | |
| 6,502,771 | B1 | * | 1/2003 | Wyne | 239/663 |
| 6,523,806 | B2 | | 2/2003 | Bartal | |
| 6,651,960 | B1 | | 11/2003 | Koester | |
| 6,964,121 | B2 | * | 11/2005 | Harris | 37/231 |

FOREIGN PATENT DOCUMENTS

| | | |
|---|---|---|
| DE | 4339127 | 5/1994 |

* cited by examiner

*Primary Examiner*—Emmanuel M Marcelo
(74) *Attorney, Agent, or Firm*—Richard C. Litman

(57) ABSTRACT

The receiver winch mount is a support for electric or hydraulic winches used on vehicles. The mount secures over the hitch assembly and positions the winch above the vehicle's bumper, so that the winch is not exposed to damage due to the vehicle maneuvering into stationary objects. The mount has a flat mounting plate, onto which the winch may be secured. The mount has two posts extending up from the mounting plate, to which a fairlead may be secured. A stub shaft is permanently secured to the bottom of the mounting plate, with structural reinforcing frame members extending from the stub shaft and also permanently secured to the bottom of the mounting plate. The stub shaft is secured to the hitch receiver using a mounting pin.

14 Claims, 14 Drawing Sheets

RECEIVER WINCH MOUNT

CROSS-REFERENCE TO RELATED APPLICATION

This application claims the benefit of U.S. Provisional Patent Application Ser. No. 60/681,144, filed May 16, 2005.

BACKGROUND OF THE INVENTION

1. Field of the Invention

The present invention relates to mounting brackets. More specifically, the invention relates to mounting brackets for winches that mount onto a receiver hitch on a vehicle.

2. Description of the Related Art

Electric and hydraulic winches are commonly used by ranchers, farmers, contractors, ATV users, and others to pull or secure large, heavy objects. The winches are often mounted to the front or rear of a vehicle, where they may be used to haul a trailer, pull out a tree stump, lift a load of construction materials, etc. When attached to the vehicle, the winches often are secured to the hitch assembly, causing the winch to extend out from the body of the vehicle. This exposes the winch to damage that may occur if the driver accidentally runs the winch into a stationary object, as the driver maneuvers the vehicle. The damage often renders the winch unusable, and necessitates the user having to replace the winch more often than simple wear and tear on the winch would require.

While the winches are often mounted on the receiver hitches of vehicles, they may also be used with trailers or other hitch assemblies. This requires either that the hitch mounts must be easily removable, or that multiple hitches be used. Additionally, because winches are often used in conjunction with a trailer to secure and haul a boat, jet ski, etc., it is often necessary for the user to be able to mount the winch on the hauling vehicle when using the hitch to secure the trailing vehicle or boat.

Thus, a receiver winch mount solving the aforementioned problems is desired.

SUMMARY OF THE INVENTION

The receiver winch mount is a support for mounting an electric or hydraulic winch on a vehicle. The mount secures over the hitch assembly and positions the winch above the vehicle's bumper, so that the winch is not exposed to damage due to collisions with stationary objects while maneuvering the vehicle.

The mount has a flat mounting plate, onto which the electric or hydraulic winch may be secured. The mount has two posts extending up from the mounting plate, to which a fairlead may be secured. A square stub shaft is permanently secured to the bottom of the mounting plate, with structural reinforcement frame members extending from the stub shaft and also permanently secured to the bottom of the mounting plate. The stub shaft is secured to the hitch using a removable mounting pin, allowing the mounting plate to be easily removed from the hitch and either moved to a different hitch assembly, or placed in storage.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
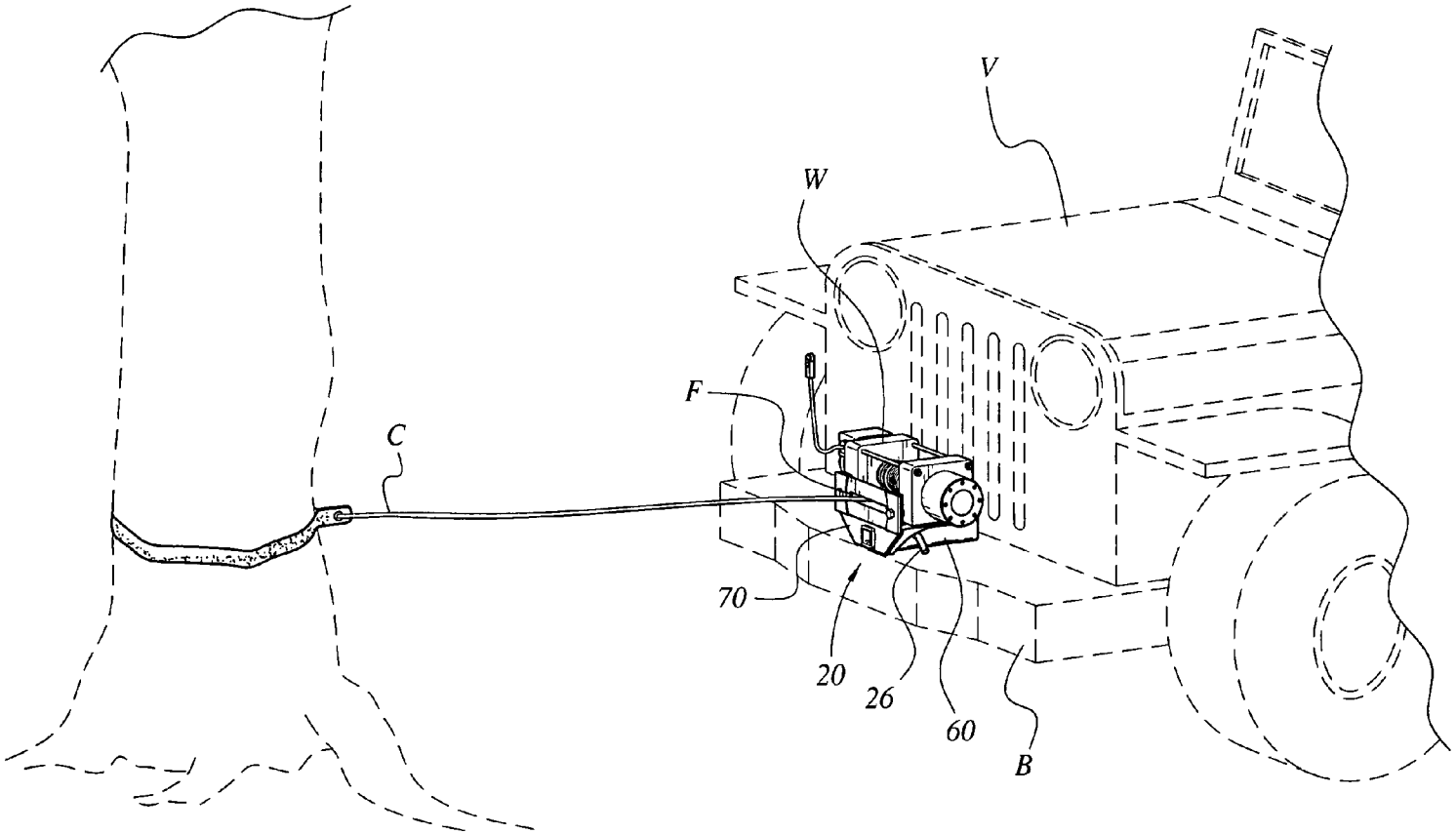
FIG. 1 is an environmental, perspective view of a receiver winch mount according to the present invention.
Figure 2:
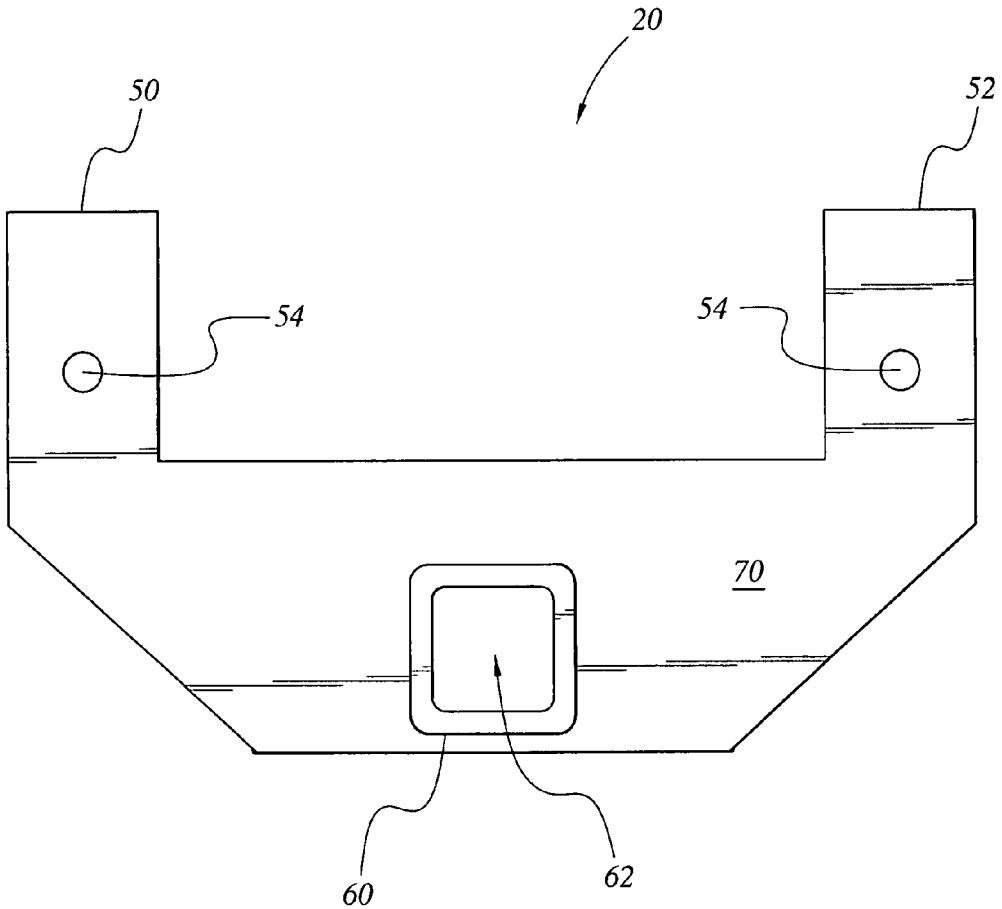
FIG. 2 is a front view of a receiver winch mount according to the present invention.
Figure 3:
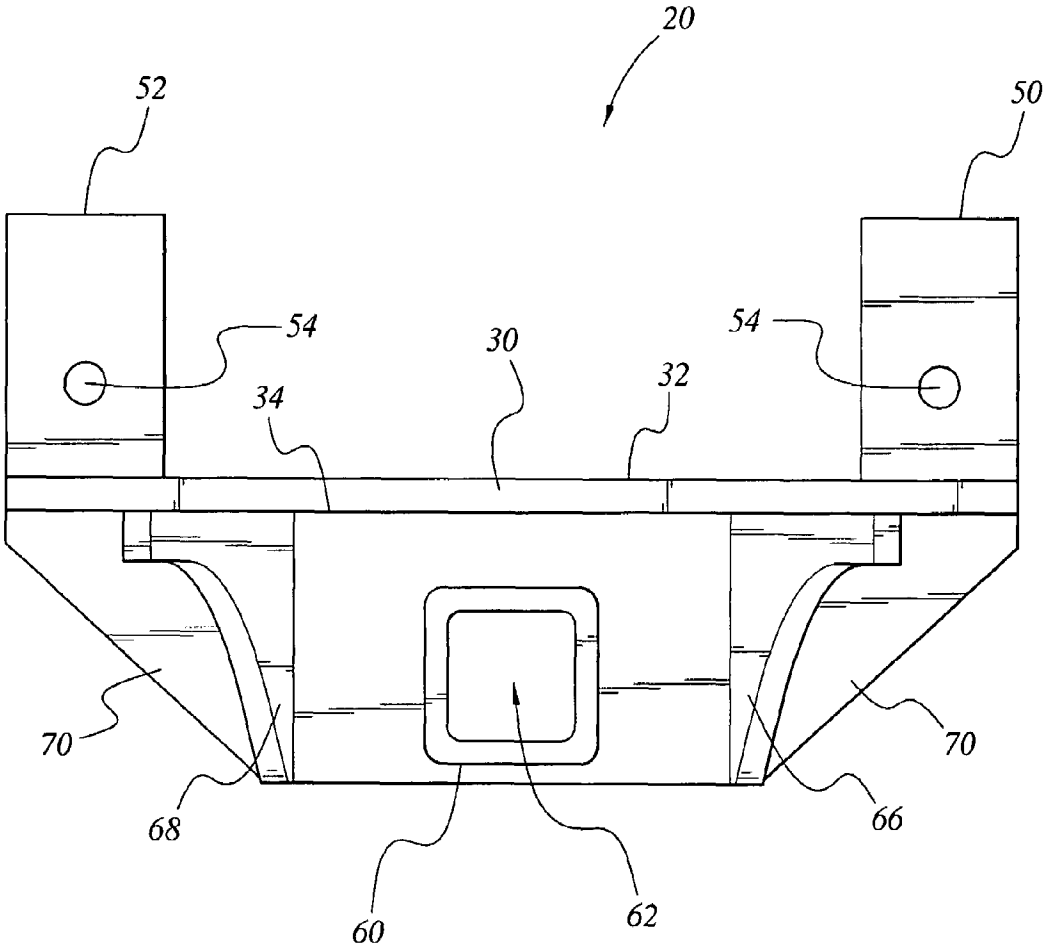
FIG. 3 is a back view of a receiver winch mount according to the present invention.
Figure 4:
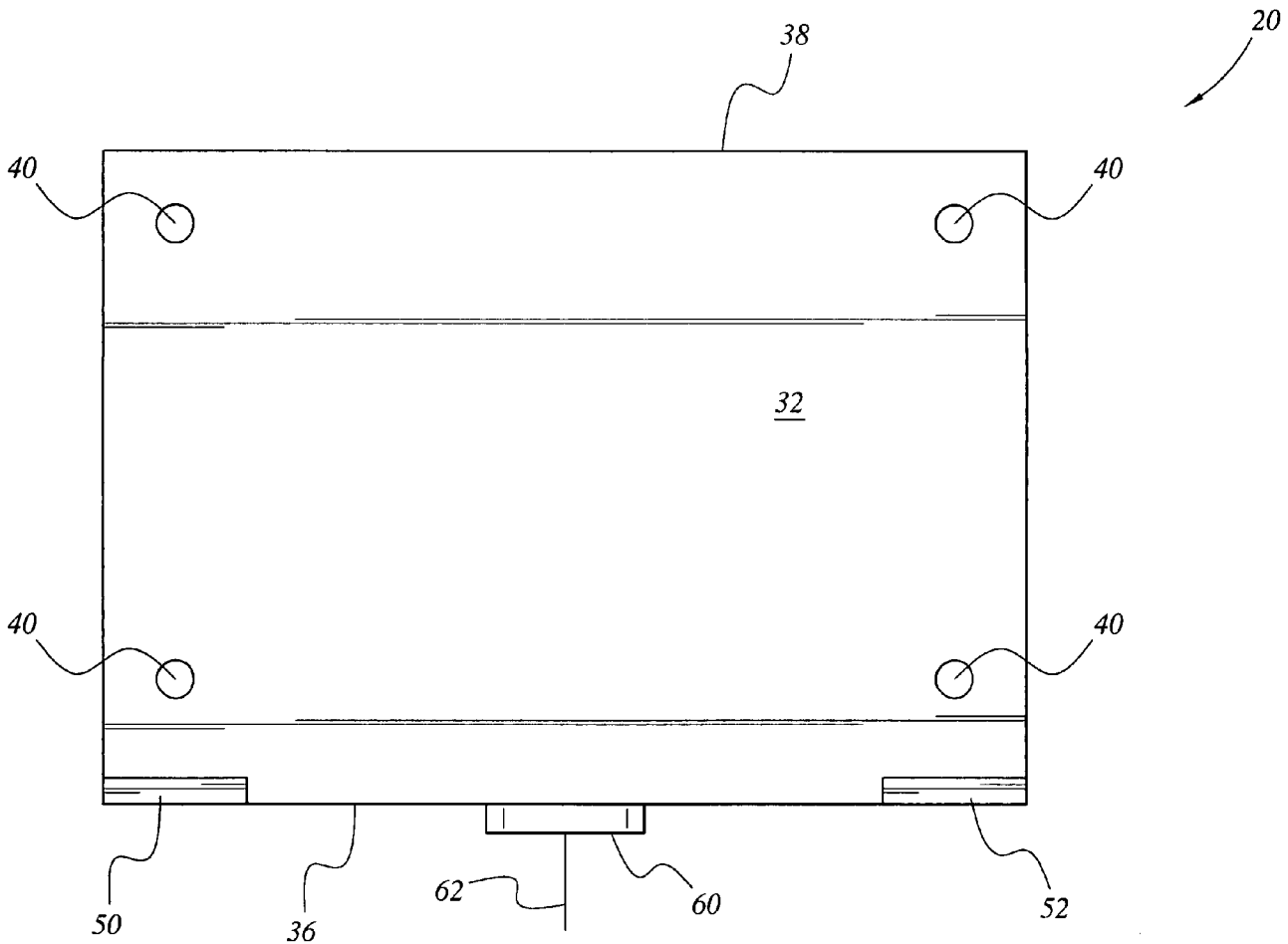
FIG. 4 is a top view of a receiver winch mount according to the present invention.

The present invention is a receiver winch mount, designated generally as 20 in the figures. The receiver winch mount 20 is a support for electric or hydraulic winches W mounted on vehicles V, for example, as shown in FIG. 1. The mount 20 secures over the receiver of the hitch assembly and positions the winch W above the vehicle's bumper B, so that the winch W is not exposed to damage due to the vehicle V maneuvering, accidentally or otherwise, into stationary objects.

As shown in FIGS. 2-6, the receiver winch mount 20 has a flat mounting plate 30, onto which the electric or hydraulic winch W may be secured. The mounting plate 30 includes a top surface 32, a bottom surface 34, a front end 36, and a rear end 38. Bolt holes 40 may be defined in the corners of the mounting plate 30, and may be used to bolt the winch W to the top surface 32 of the mounting plate 30 near the rear end 38. The bolt holes 40 allow the winch W to be removably secured to the mounting plate 30, so that if the winch W needs to be replaced or put in storage, the winch W may be quickly and easily detached from the mounting plate 30.

Figure 7:
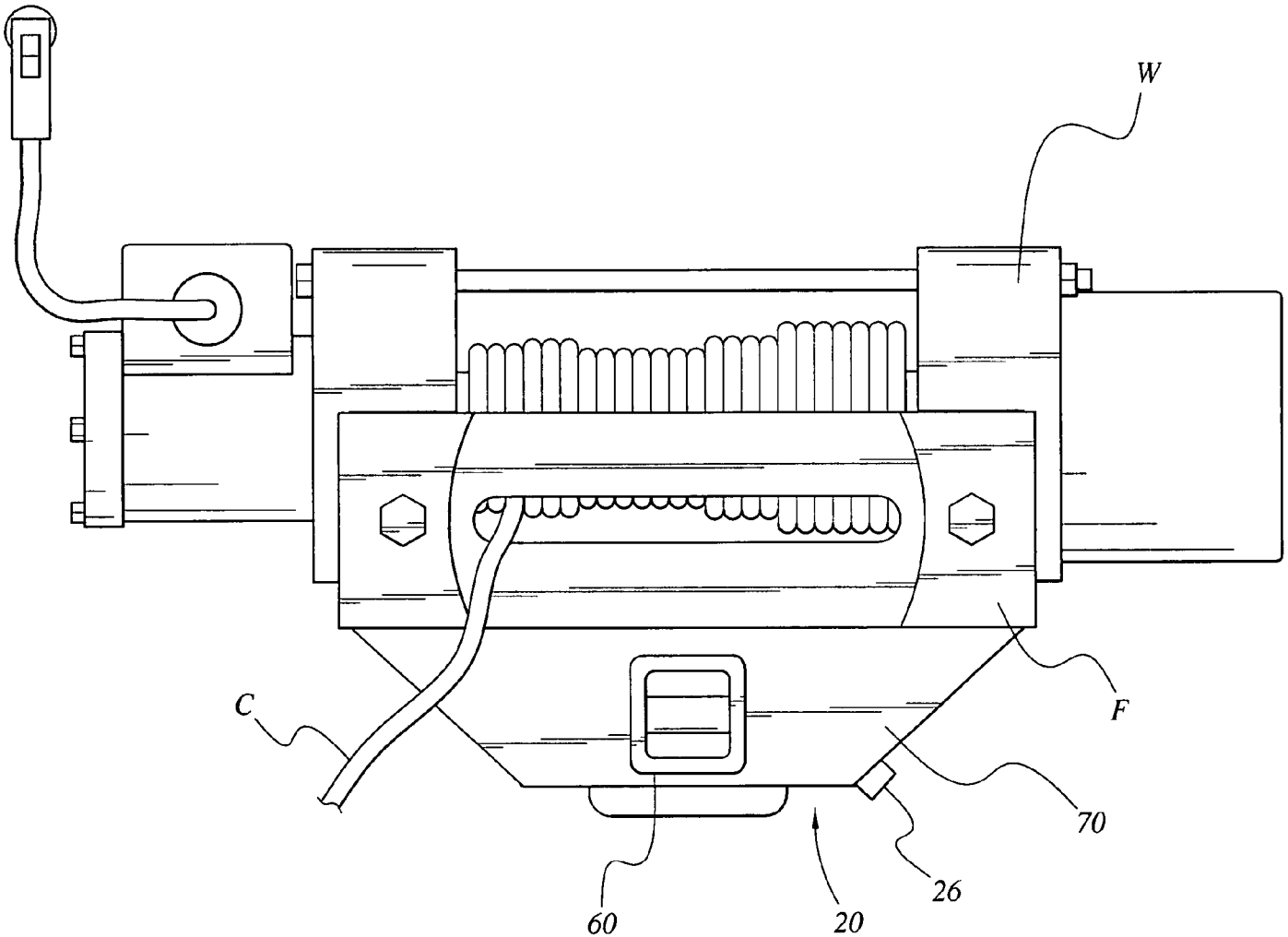
FIG. 7 is a front view of a receiver winch mount according to the present invention with a winch and a fairlead installed.
Figure 8:
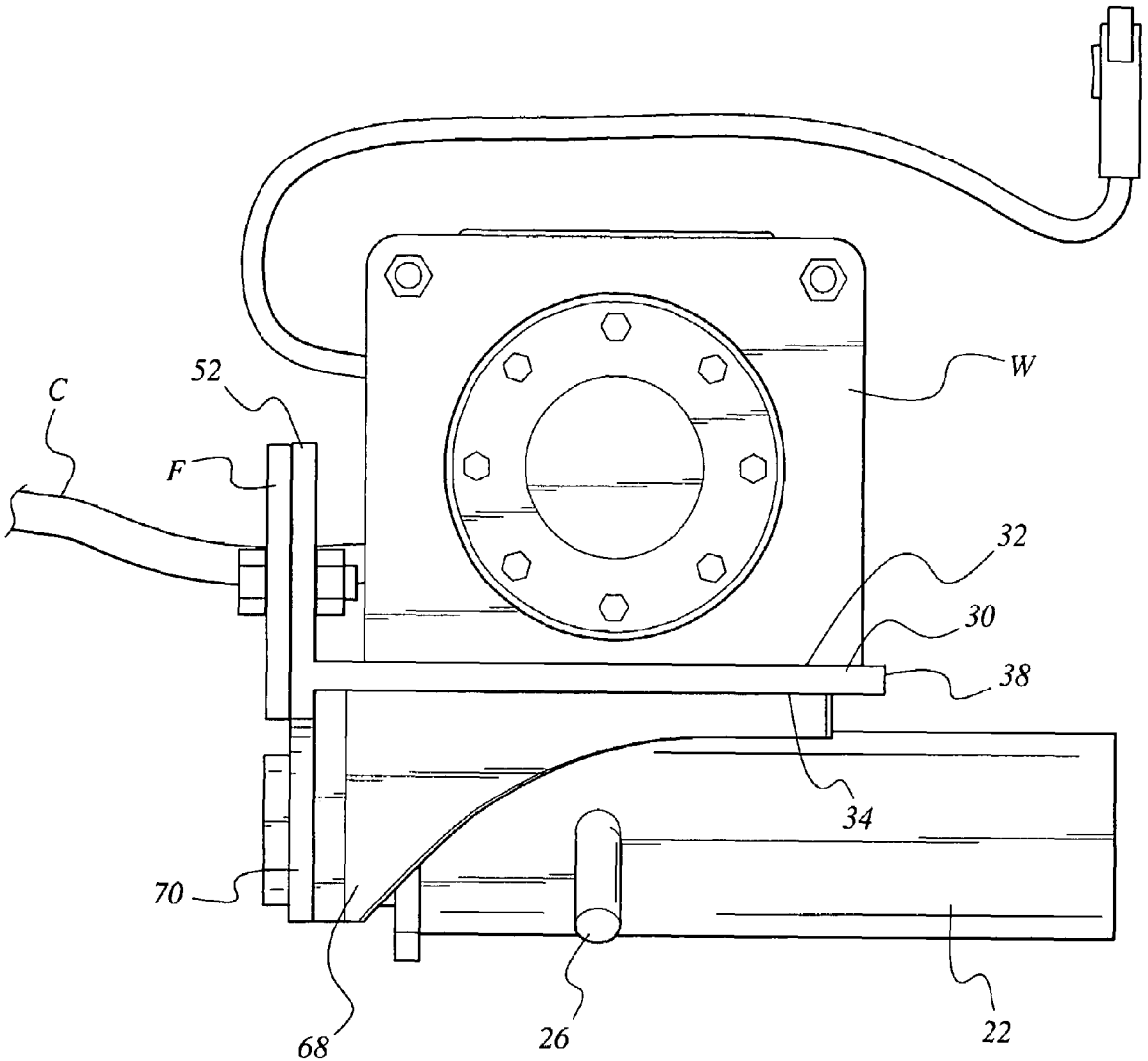
FIG. 8 is a side view of a receiver winch mount according to the present invention with a winch and a fairlead installed.

The mount 20 has a first post 50 and a second post 52 extending up from the top surface 32 of the mounting plate 30 adjacent the front end 36, to which a fairlead F may be secured. Posts 50 and 52 are flat, and may be tabs integral with front plate 70, described below. Bolt holes 54 may be defined in both the first post 50 and the second post 52, and may be used to bolt the fairlead F to the first post 50 and second post 52. The bolt holes 54 allow the fairlead F to be removably secured to the receiver winch mount 20, so that if the fairlead F is not desired for use, or if the fairlead F is damaged, it may be removed from the mount 20. The fairlead F may be used to guide a winch cable C, used in combination with winch W, as can be seen in FIGS. 7 and 8.

Figure 11:
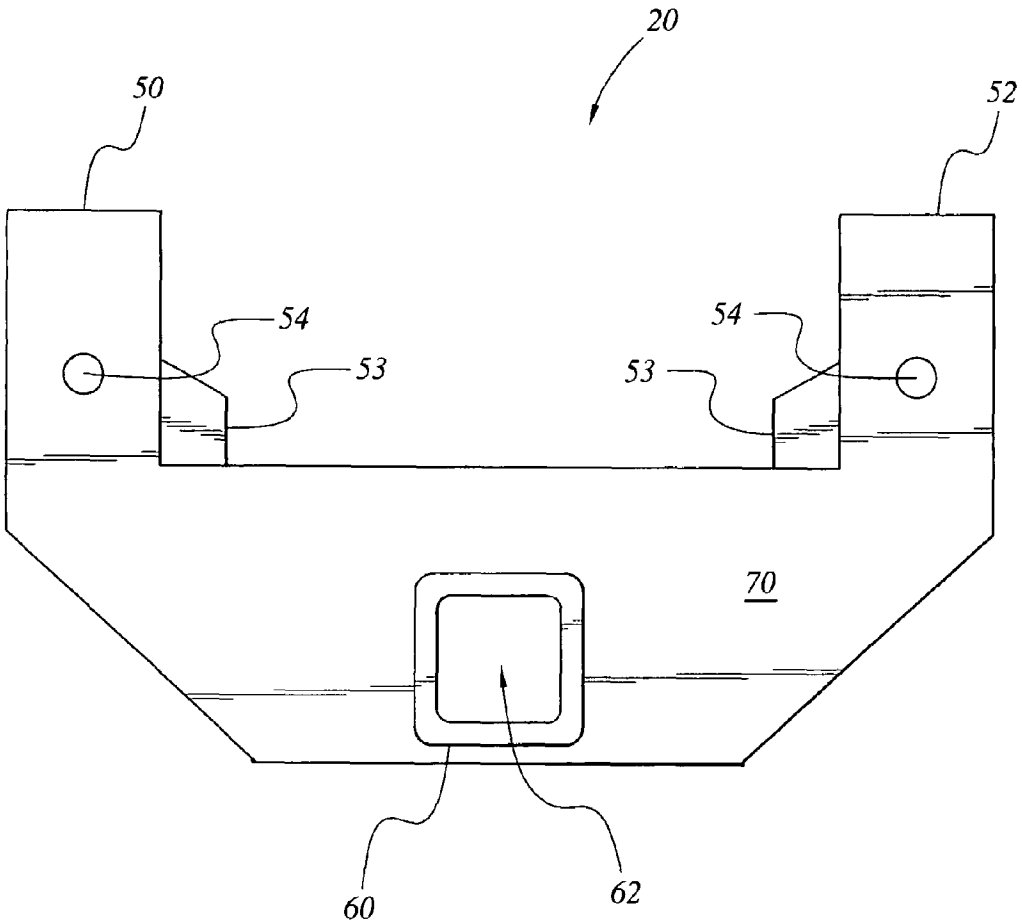
FIG. 11 is a front view of an alternative embodiment of the receiver winch mount according to the present invention.
Figure 12:
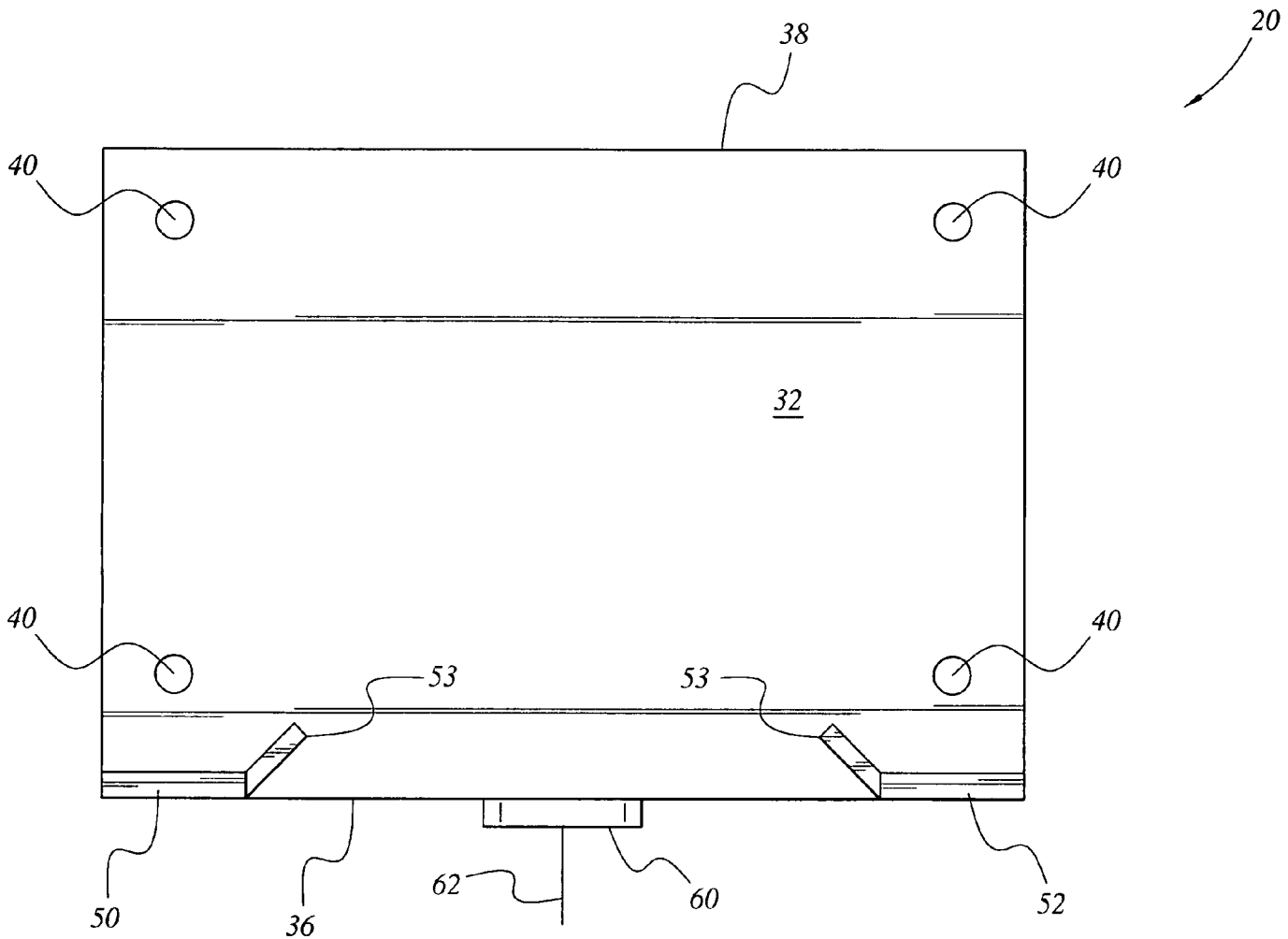
FIG. 12 is a top view of the receiver winch mount of FIG. 11.

As shown in FIGS. 11 and 12, a pair of fairlead supports 53 may be further mounted on the upper surface 32 of mounting plate 30. Each fairlead support 53 is joined to a respective one of posts 50, 52, as shown, and extends rearwardly therefrom (towards rear end 38 of mounting plate 30), with each extending support 53 being angled inward to provide horizontal support for fairlead F.

Figure 10:
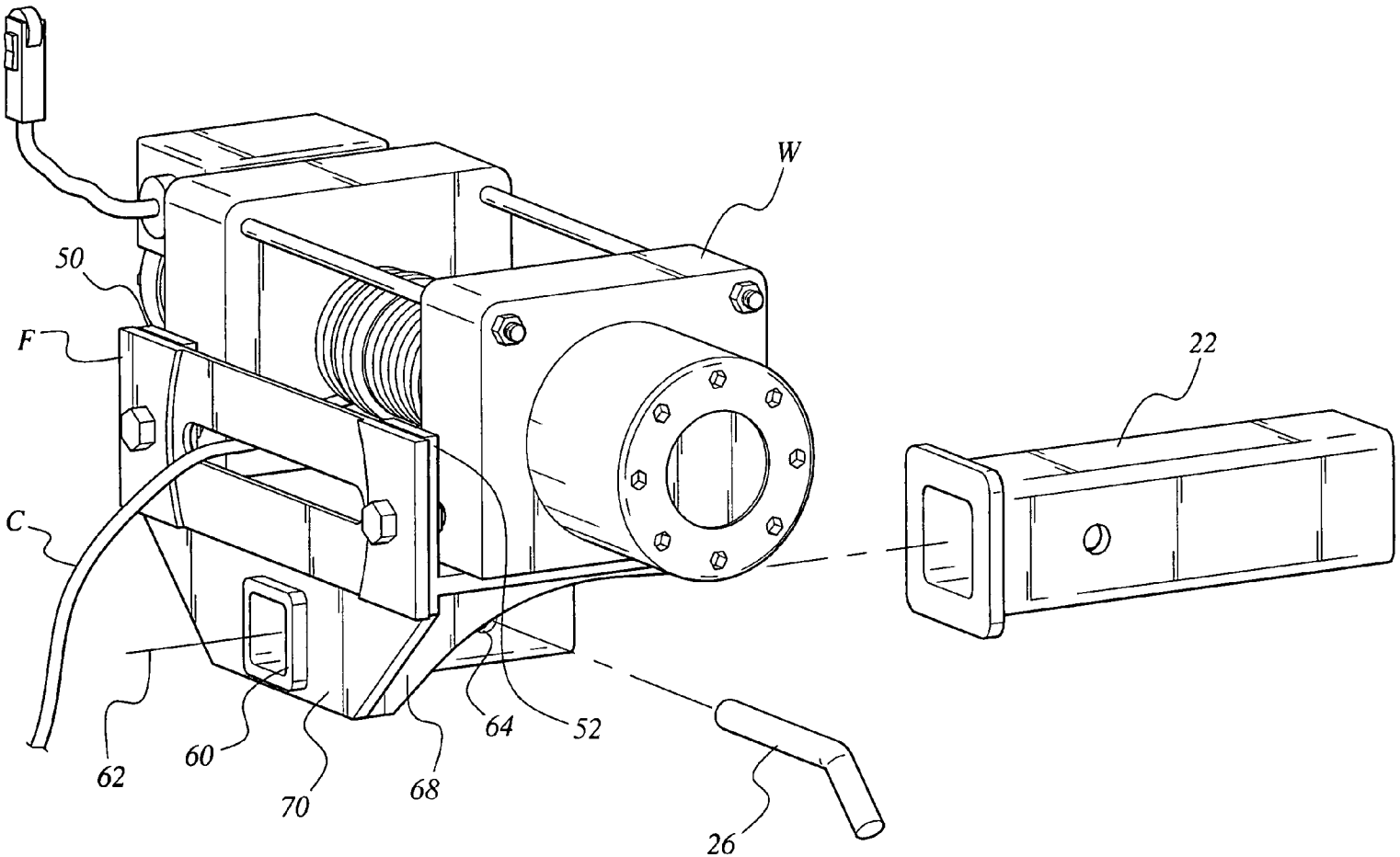
FIG. 10 is an exploded view of a receiver winch mount and hitch assembly according to the present invention.

A square stub shaft 60 is permanently secured beneath the bottom surface 34 of the mounting plate 30. The stub shaft 60 is a tubular member with a central axis 62 that is oriented to extend from the front end 36, of the mounting plate, to the rear end 38. The stub shaft 60 is adapted to be received by the hitch receiver 22, as shown in FIG. 10, in the hitch assembly 24 on the vehicle V. The stub shaft 60 additionally includes a pin hole 64, which is adapted to receive a receiver pin 26. The receiver pin 26 secures the stub shaft 60 to the hitch receiver 22, while allowing the receiver winch mount 20 to be easily removed from the hitch assembly 24 and either moved to a different hitch assembly or placed in storage.

Figure 5:
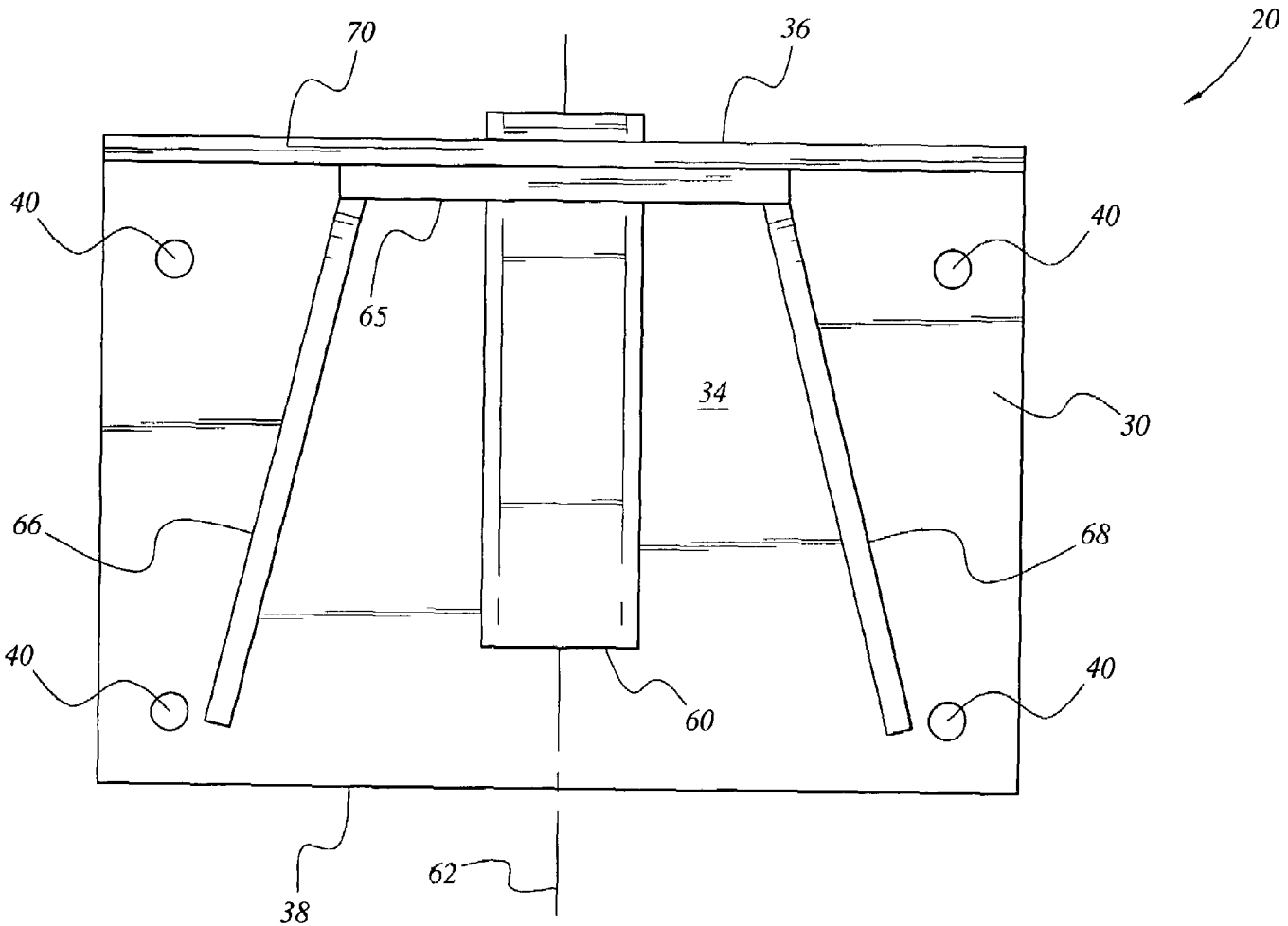
FIG. 5 is a bottom view of a receiver winch mount according to the present invention.
Figure 6:
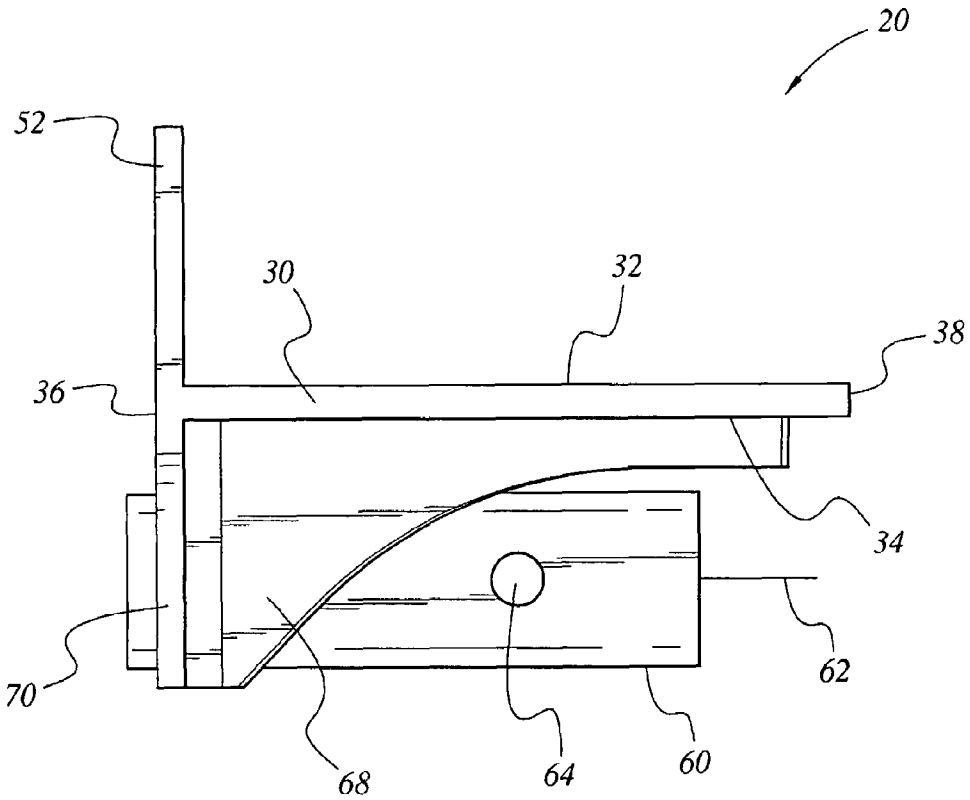
FIG. 6 is a side view of a receiver winch mount according to the present invention.

Referring particularly to FIGS. 5 and 6, the square stub shaft is supported by a generally V-shaped support formed by first structural reinforcement frame member 66, second structural reinforcement frame member 68, and stress plate 65 extending across the apex of the V-shape. Front plate 70 extends across the front edge 36 of plate 30. Stress plate 65 is formed from steel plate of suitable thickness to withstand the force exerted on the receiver winch mount 20 by the load being pulled. As a working example, for a 9,000 pound capable winch, the stress plate 65 should be at least ½" thick. For use with a 12,000 pound capable winch, the stress plate should be at least ¾" thick. Aligned holes are formed in stress plate 65, and stub shaft 60 is inserted through the aligned hole and welded to stress plate 65, the stub shaft 60 being spaced apart from plate 30 by a distance sufficient to mount the stub shaft 60 on hitch receiver 22 and allow plate 30 to extend above the stub shaft 60. Stress plate 65 is welded to plate 30 and also to front plate 70, and its top edge may be welded to plate 30.

Members 66 and 68 form the wings of the V-shaped support. Members 66 and 68 extend relatively deeply anteriorly adjacent front plate 70 and are tapered, or are arcuately curved to a shallow depth posteriorly adjacent rear edge 38. Members 66 and 68 are welded to stress plate 65, and also to the bottom surface 34 of plate 30. The shape of members 66 and 68 permits access to insert pin 26 through stub shaft 60 and hitch receiver 22. The thickness of stress plate 65, with the additional support of front plate 70, is sufficient to support the load of a winch and plate 30 on receiver 22. The front plate 70 also protects the mount 20 from damage due to contact with external stationary objects during maneuvering of the vehicle V. It should be further understood that stub shaft 60 may project through front plate 70, as shown in the Figures, or may be sized such that the stub shaft 60 is only mounted to front plate 70, and does not project forwardly therefrom. Similarly, as shown in the Figures, in the preferred embodiment, the stub shaft 60 extends through the stress plate 65. Alternatively, the stub shaft 60 may be mounted to stress plate 65, without passing through stress plate 65, and may be permanently joined thereto by welding or the like.

Figure 13:
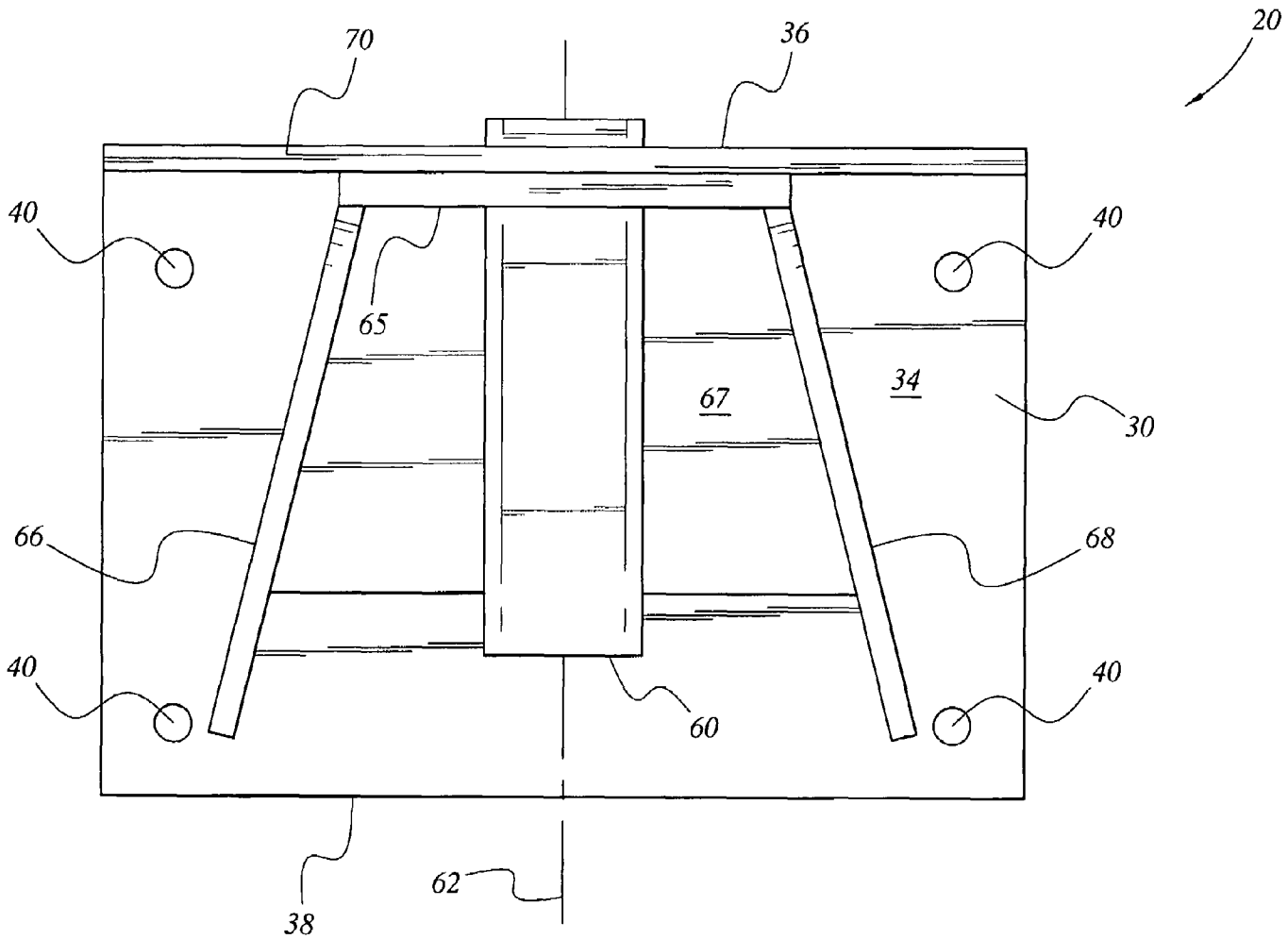
FIG. 13 is a bottom view of another alternative embodiment of the receiver winch mount according to the present invention.
Figure 14:
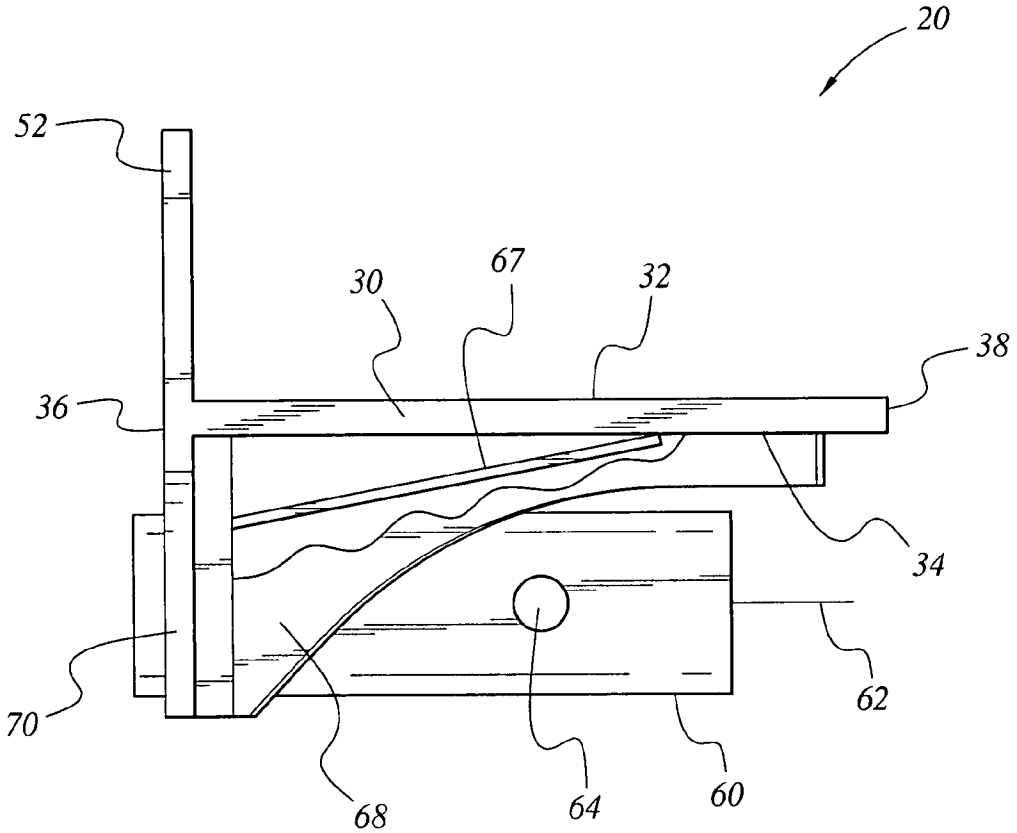
FIG. 14 is a side cut-away view of the alternative embodiment of the receiver winch mount shown in FIG. 13.

Additionally, as shown in cut-away in FIG. 14, an additional support member 67 may be joined, through welding or the like, to stress plate 65 and mounting plate 30. The front end of support member 67 is joined to an upper portion of stress plate 65 and the rear end of support member 67 is joined to the lower surface of the mounting plate, such that support member 67 provides additional vertical support for mounting plate 30 when the winch is mounted thereon. Additionally, support member 67 prevents buckling of the mounting plate 30 under the stress and strain of an unbalanced load. As shown in FIG. 13, the support member 67 extends laterally between the V-shaped frame members 66, 68.

Figure 9:
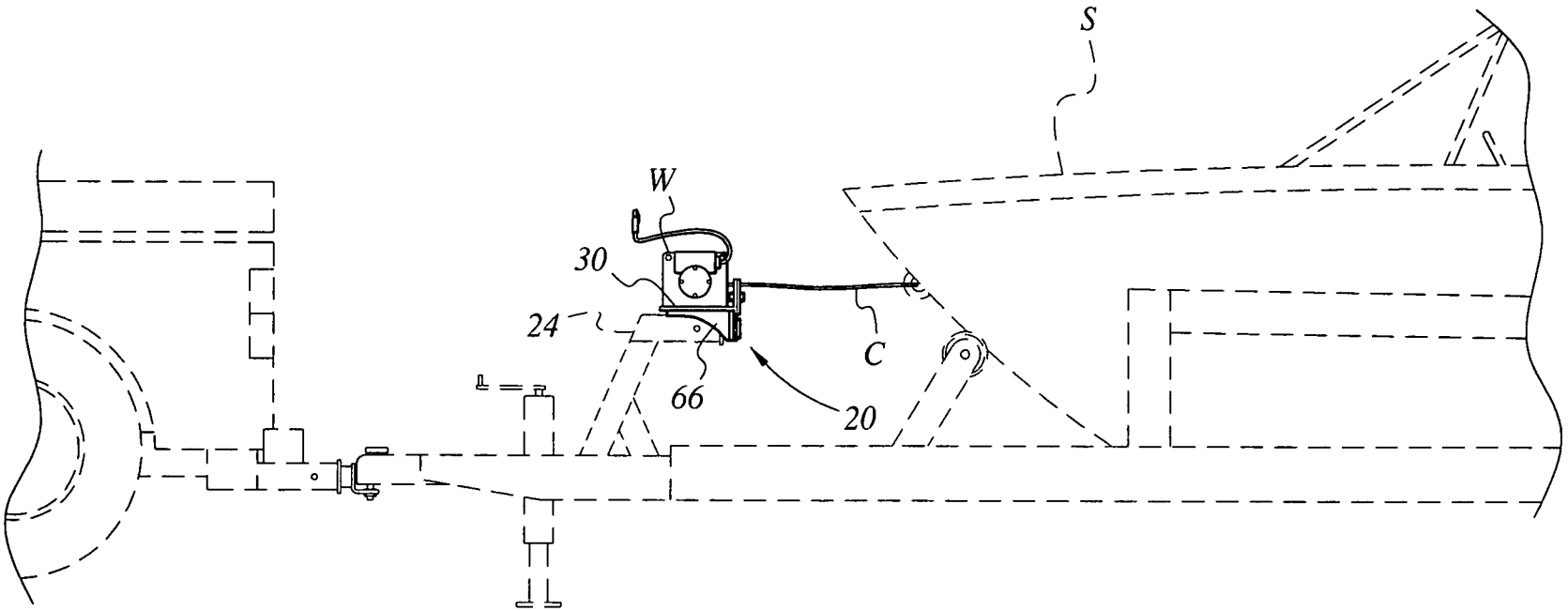
FIG. 9 is an environmental, side view of a receiver winch mount on a boat trailer according to the present invention.

While the receiver winch mount 20 is designed to support an electric or hydraulic winch W above and recessed slightly behind a vehicle's bumper B, the mount may be used on other hitch assemblies. As shown in FIG. 9, the mount 20 may be secured to the hitch assembly on a trailer, with the winch cable C connecting to the boat S supported by the trailer.

It is to be understood that the present invention is not limited to the embodiment described above, but encompasses any and all embodiments within the scope of the following claims.

I claim:

1. A receiver winch mount, comprising:

a mounting plate having a top surface, a bottom surface, a front end, and a rear end, the mounting plate being adapted for having a winch secured thereto;

a V-shaped support having a stress plate and two support plates angled rearwardly from opposite sides of the stress plate in a generally V-shaped configuration, the V-shaped support depending from the bottom surface of the mounting plate; and, a stub shaft having a front end mounted to the stress plate, the stub shaft being spaced apart from and extending beneath the mounting plate and having a central axis oriented in a direction extending from the front end toward the rear end, the stub shaft being adapted for being received by a receiver member of a hitch assembly, whereby the winch is supported on the mounting plate above the stub shaft.

2. The receiver winch mount as recited in claim 1, further comprising means for releasably attaching said stub shaft to said receiver member.

3. The receiver winch mount as recited in claim 2, wherein each of said support plates has a tapered contour, allowing the user access to said means for releasably attaching.

4. The receiver winch mount as recited in claim 2, wherein each of said support plates has a substantially arcuate contour, allowing the user access to said means for releasably attaching.

5. The receiver winch mount as recited in claim 1, further comprising means for releasably securing said winch to the top surface of said mounting plate.

6. The receiver winch mount as recited in claim 1, wherein said mounting plate has a substantially planar contour, the receiver winch mount further comprising a front plate, the front plate having a substantially planar contour, the front plate being disposed substantially orthogonal to said mounting plate, the front plate being mounted to the front end of said mounting plate, the front plate having an opening formed therethrough for receiving the front end of said stub shaft.

7. The receiver winch mount as recited in claim 6, wherein said front plate further includes a pair of posts projecting upwardly therefrom, the posts being disposed adjacent respective laterally opposed ends of said front plate.

8. The receiver winch mount as recited in claim 7, further comprising a fairlead received between said pair of posts, the fairlead being releasably secured to said front plate.

9. The receiver winch mount as recited in claim 8, further comprising means for releasably attaching said fairlead to said pair of posts.

10. The receiver winch mount as recited in claim 8, further comprising a pair of fairlead supports mounted on the top surface of said mounting plate, each of the fairlead supports being joined to an inner edge of a respective one of said posts, each of the fairlead supports extending rearwardly from the front end of said mounting plate, the pair of fairlead supports being adapted for providing horizontal support for said fairlead.

11. The receiver winch mount as recited in claim 10, wherein each of said fairlead supports has a front end and a rear end, said pair of fairlead supports being angled so that the distance between the front ends of said pair of fairlead supports is greater than the distance between the rear ends of said pair of fairlead supports.

12. The receiver winch mount as recited in claim 1, further comprising a support member having a front end and a rear end, the front end of the support member being joined to an upper portion of said stress plate, the rear end of the support member being joined to the bottom surface of said mounting plate, the support member providing vertical structural support for said mounting plate when said winch is mounted on said mounting plate.

13. The receiver winch mount as recited in claim 12, wherein said support member extends in a substantially lateral direction between the support plates of said V-shaped support.

14. The receiver winch mount as recited in claim 1, wherein said stress plate has an opening formed therein, the front end of said stub shaft being received by, and extending through, the opening in said stress plate.

* * * * *